US008892015B2

(12) United States Patent
Kunii et al.

(10) Patent No.: US 8,892,015 B2
(45) Date of Patent: Nov. 18, 2014

(54) FIXING DEVICE AND IMAGE FORMING APPARATUS INCORPORATING SAME

(75) Inventors: Hiroyuki Kunii, Kanagawa (JP); Akiyasu Amita, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 182 days.

(21) Appl. No.: 13/363,781

(22) Filed: Feb. 1, 2012

(65) Prior Publication Data

US 2012/0201579 A1 Aug. 9, 2012

(30) Foreign Application Priority Data

Feb. 8, 2011 (JP) ..... 2011-024970

(51) Int. Cl.
*G03G 15/20* (2006.01)
*G03G 15/00* (2006.01)

(52) U.S. Cl.
CPC .... *G03G 15/6585* (2013.01); *G03G 2215/0081* (2013.01); *G03G 2215/00805* (2013.01); *G03G 2215/2006* (2013.01); *G03G 2215/2032* (2013.01)
USPC ..... 399/328; 399/329

(58) Field of Classification Search
USPC ..... 399/164
See application file for complete search history.

(56) References Cited

U.S. PATENT DOCUMENTS 4,862,215 A * 8/1989 Nomura et al. ..... 399/400
5,819,140 A * 10/1998 Iseki et al. ..... 399/165
6,792,236 B2 * 9/2004 Yoda et al. ..... 399/325
6,813,464 B2 11/2004 Amita et al.
6,957,036 B2 10/2005 Kikuchi et al.
7,010,257 B2 3/2006 Someya et al.
7,031,648 B2 4/2006 Takashi et al.
7,054,570 B2 5/2006 Kishi et al.
7,116,923 B2 10/2006 Kishi et al.
7,127,202 B2 10/2006 Fujita et al.
7,130,555 B2 10/2006 Kishi et al.

(Continued)

FOREIGN PATENT DOCUMENTS

CN 1501184 6/2004
CN 101685288 3/2010

(Continued)

OTHER PUBLICATIONS

Office Action for corresponding Chinese Patent application No. 201210022664.9 dated Feb. 25, 2014.

*Primary Examiner* — Clayton E Laballe
*Assistant Examiner* — Jas Sanghera
(74) *Attorney, Agent, or Firm* — Harness, Dickey & Pierce, P.L.C.

(57) ABSTRACT

A fixing device includes a first roller, a second roller, an endless belt, a third roller, a heater, a cooler, and a belt tensioner. The second roller is parallel to the first roller. The endless belt is looped for rotation around the first and second rollers. The third roller is opposite the first roller via the belt. The heater is in at least one of the rollers to heat the roller to in turn heat the belt. The cooler is inside the loop of the belt between the first and second rollers to cool the belt. The first and third rollers press against each other to form a nip therebetween through which a recording medium is conveyed. The belt tensioner is in contact with the belt to tension the belt in a transverse direction perpendicular to a longitudinal direction of the belt.

18 Claims, 9 Drawing Sheets

(56) References Cited

U.S. PATENT DOCUMENTS

| | | | | |
|---|---|---|---|---|
| 7,139,520 | B2 | 11/2006 | Echigo et al. | |
| 7,177,580 | B2 | 2/2007 | Nakafuji et al. | |
| 7,209,675 | B2 | 4/2007 | Matsusaka et al. | |
| 7,212,758 | B2 | 5/2007 | Kishi et al. | |
| 7,212,759 | B2 | 5/2007 | Kishi et al. | |
| 7,233,762 | B2 | 6/2007 | Kunii et al. | |
| 7,239,821 | B2 | 7/2007 | Matsusaka et al. | |
| 7,254,362 | B2 | 8/2007 | Kikuchi et al. | |
| 7,269,384 | B2 | 9/2007 | Someya et al. | |
| 7,299,003 | B2 | 11/2007 | Kurotaka et al. | |
| 7,308,216 | B2 | 12/2007 | Kishi et al. | |
| 7,333,743 | B2 | 2/2008 | Kishi et al. | |
| 7,333,760 | B2 | 2/2008 | Baba et al. | |
| 7,343,113 | B2 | 3/2008 | Matsusaka et al. | |
| 7,356,270 | B2 | 4/2008 | Matsusaka et al. | |
| 7,359,666 | B2 | 4/2008 | Takashi et al. | |
| 7,366,432 | B2 | 4/2008 | Kishi et al. | |
| 7,369,803 | B2 | 5/2008 | Echigo et al. | |
| 7,373,094 | B2 | 5/2008 | Kishi et al. | |
| 7,433,641 | B2 | 10/2008 | Kikuchi et al. | |
| 7,496,309 | B2 | 2/2009 | Matsusaka et al. | |
| 7,515,845 | B2 | 4/2009 | Kishi et al. | |
| 7,526,242 | B2 | 4/2009 | Takagaki et al. | |
| 7,551,869 | B2 | 6/2009 | Kishi et al. | |
| 7,565,087 | B2 | 7/2009 | Matsusaka et al. | |
| 7,570,911 | B2 | 8/2009 | Nakafuji et al. | |
| 7,583,922 | B2 | 9/2009 | Takashi et al. | |
| 7,603,049 | B2 | 10/2009 | Kishi et al. | |
| 7,609,988 | B2 | 10/2009 | Kishi et al. | |
| 7,664,410 | B2 | 2/2010 | Takagi | |
| 7,738,827 | B2 | 6/2010 | Someya et al. | |
| 7,885,569 | B2 | 2/2011 | Kishi et al. | |
| 7,912,392 | B2 | 3/2011 | Yoshinaga et al. | |
| 7,925,177 | B2 | 4/2011 | Ishii et al. | |
| 7,957,663 | B2 | 6/2011 | Kishi et al. | |
| 8,073,352 | B2 | 12/2011 | Kunii et al. | |
| 8,081,903 | B2 * | 12/2011 | Hasegawa | 399/122 |
| 2002/0057934 | A1 * | 5/2002 | Ishikawa et al. | 399/328 |
| 2003/0035666 | A1 | 2/2003 | Ishikawa et al. | |
| 2003/0165348 | A1 | 9/2003 | Amita et al. | |
| 2004/0037595 | A1 | 2/2004 | Takashi et al. | |
| 2004/0146325 | A1 * | 7/2004 | Tani et al. | 399/329 |
| 2004/0245241 | A1 | 12/2004 | Kishi et al. | |
| 2004/0247332 | A1 | 12/2004 | Kishi et al. | |
| 2004/0247334 | A1 | 12/2004 | Kishi et al. | |
| 2004/0258426 | A1 | 12/2004 | Kishi et al. | |
| 2005/0025534 | A1 | 2/2005 | Fujita et al. | |
| 2005/0025537 | A1 | 2/2005 | Echigo et al. | |
| 2005/0117943 | A1 | 6/2005 | Nakafuji et al. | |
| 2005/0139584 | A1 | 6/2005 | Kishi et al. | |
| 2005/0152721 | A1 | 7/2005 | Kikuchi et al. | |
| 2005/0158075 | A1 | 7/2005 | Echigo et al. | |
| 2005/0175368 | A1 | 8/2005 | Matsusaka et al. | |
| 2005/0175370 | A1 | 8/2005 | Matsusaka et al. | |
| 2005/0191078 | A1 | 9/2005 | Kishi et al. | |
| 2005/0201783 | A1 | 9/2005 | Kurotaka et al. | |
| 2005/0207801 | A1 | 9/2005 | Kunii et al. | |
| 2005/0286920 | A1 | 12/2005 | Baba et al. | |
| 2006/0008302 | A1 | 1/2006 | Someya et al. | |
| 2006/0013624 | A1 | 1/2006 | Kurotaka et al. | |
| 2006/0019082 | A1 | 1/2006 | Kikuchi et al. | |
| 2006/0029411 | A1 | 2/2006 | Ishii et al. | |
| 2006/0039713 | A1 | 2/2006 | Kishi et al. | |
| 2006/0051111 | A1 | 3/2006 | Kishi et al. | |
| 2006/0051112 | A1 | 3/2006 | Matsusaka et al. | |
| 2006/0051113 | A1 | 3/2006 | Kishi et al. | |
| 2006/0051119 | A1 | 3/2006 | Kishi et al. | |
| 2006/0051120 | A1 | 3/2006 | Kishi et al. | |
| 2006/0051121 | A1 | 3/2006 | Matsusaka et al. | |
| 2006/0088349 | A1 | 4/2006 | Someya et al. | |
| 2006/0120776 | A1 | 6/2006 | Takashi et al. | |
| 2006/0127118 | A1 | 6/2006 | Kishi et al. | |
| 2006/0140689 | A1 | 6/2006 | Echigo et al. | |
| 2006/0182460 | A1 | 8/2006 | Kishi et al. | |
| 2007/0014600 | A1 | 1/2007 | Ishii et al. | |
| 2007/0031159 | A1 | 2/2007 | Kishi et al. | |
| 2007/0065188 | A1 | 3/2007 | Takagaki et al. | |
| 2007/0104520 | A1 | 5/2007 | Nakafuji et al. | |
| 2007/0212090 | A1 | 9/2007 | Matsusaka et al. | |
| 2008/0145088 | A1 | 6/2008 | Matsusaka et al. | |
| 2008/0219716 | A1 | 9/2008 | Takashi et al. | |
| 2008/0253789 | A1 | 10/2008 | Yoshinaga et al. | |
| 2009/0123172 | A1 | 5/2009 | Kishi et al. | |
| 2009/0169232 | A1 | 7/2009 | Kunii et al. | |
| 2009/0317113 | A1 | 12/2009 | Kishi et al. | |
| 2010/0074662 | A1 | 3/2010 | Hasegawa | |
| 2010/0232818 | A1 | 9/2010 | Kunii | |
| 2011/0064494 | A1 | 3/2011 | Amita et al. | |
| 2011/0085815 | A1 | 4/2011 | Kishi et al. | |
| 2011/0176822 | A1 | 7/2011 | Ishii et al. | |
| 2011/0188911 | A1 | 8/2011 | Kunii et al. | |
| 2012/0008153 | A1 | 1/2012 | Kunii et al. | |

FOREIGN PATENT DOCUMENTS

| | | | |
|---|---|---|---|
| JP | 2003-270987 | A | 9/2003 |
| JP | 2004325934 | A | 11/2004 |
| JP | 2010-175617 | A | 8/2010 |

* cited by examiner

FIXING DEVICE AND IMAGE FORMING APPARATUS INCORPORATING SAME

CROSS-REFERENCE TO RELATED APPLICATION

This patent application claims priority pursuant to 35 U.S.C. §119 to Japanese Patent Application No. 2011-024970, filed on Feb. 8, 2011, the entire disclosure of which is hereby incorporated by reference herein.

BACKGROUND OF THE INVENTION

1. Technical Field

The present invention relates to a fixing device and an image forming apparatus incorporating the same, and more particularly, to a fixing device that processes a toner image with heat and pressure on a recording medium, and an electrophotographic image forming apparatus, such as a photocopier, facsimile machine, printer, plotter, or multifunctional machine incorporating several of these features, which incorporates such a fixing capability.

2. Background Art

In electrophotographic image forming apparatuses, such as photocopiers, facsimile machines, printers, plotters, or multifunctional machines incorporating several of those imaging functions, an image is formed by attracting toner particles to a photoconductive surface for subsequent transfer to a recording medium such as a sheet of paper. After transfer, the imaging process is followed by a fixing process using a fixing device, which permanently fixes the toner image in place on the recording medium by melting and setting the toner with heat and pressure.

A modern image forming apparatus accommodates a wide range of printing applications using various types of recording media upon which toner images are printed and fixed, which require different levels of image quality, particularly, in terms of glossiness and uniformity of gloss across a toner image. For example, printing of photographs and computer-generated images, which typically contain multiple colors, necessitates a higher level of image quality and gloss uniformity than is required for a monochrome image as in a text-only print.

Various techniques have been developed to provide a printing process that can print a toner image with a uniform, high gloss appearance. Some of these techniques employ a special type of toner that is transparent in color, typically called "clear toner", to create transparent, glossy effects on those areas of a recording medium where any color toner is not present. Other techniques address duplex printing of toner images with uniformly high gloss on both sides of a resulting print.

For example, one such technique proposes a fixing device that includes a thermal pre-fixing unit and an image gloss adjustment unit comprising a smooth, endless rotary belt on which a recording medium is conveyed after processing through the pre-fixing unit.

In this fixing device, the pre-fixing unit initially processes an unfixed, powder toner image on a recording medium through heating, which melts toner particles into a semi-fluid, soft pliable state. After pre-fixing, the recording medium is then conveyed on the endless rotary belt with the toner image pressed against the smooth moving surface of the belt, which imparts a certain amount of gloss on the toner image as the molten toner gradually cools and solidifies while conforming to the smooth surface of the belt. The image gloss adjustment unit adjusts the glossiness of the toner image by adjusting a distance or duration during which the toner image travels on the belt while subjected to pressure.

Another technique proposes a belt-based fixing device that includes an endless fixing belt looped for rotation around multiple rollers, including a pair of first and second motor-driven rollers, as well as a cooler disposed between the first roller and another belt-supporting roller inside the loop of the fixing belt.

In this fixing device, the first motor-driven roller is driven at a rotational speed slower than that of the second motor-driven roller, so as to tighten the belt between the first motor-driven roller and the cooler downstream in a longitudinal direction in which the belt rotates around the multiple rollers. Provision of the belt tightening mechanism prevents the fixing belt from deformation due to being held on the supporting rollers for extended periods of time, as well as sags and creases resulting from thermal expansion/contraction of the belt subjected to repeated heating and cooling cycles, which would otherwise affect uniformity of gloss across a resulting image.

Although generally effective for its intended purpose, the belt-based fixing device depicted above has several drawbacks. That is, tightening the belt in the longitudinal direction to establish close contact between the belt and the cooler increases the torque required to drive the belt. Also, such arrangement necessitates an extremely high level of precision during assembly of the fixing device. Further, increased longitudinal tension in the belt can lead to accelerated wear and tear of the adjoining surfaces of the belt and the cooler, which slide against each other during rotation of the belt.

SUMMARY OF THE INVENTION

Exemplary aspects of the present invention are put forward in view of the above-described circumstances, and provide a novel fixing device.

In one exemplary embodiment, the fixing device includes a first roller, a second roller, an endless belt, a third roller, a heater, a cooler, and a belt tensioner. The second roller is parallel to the first roller. The endless belt is looped for rotation around the first and second rollers. The third roller is opposite the first roller via the belt. The heater is in at least one of the rollers to heat the roller to in turn heat the belt. The cooler is inside the loop of the belt between the first and second rollers to cool the belt. The first and third rollers press against each other to form a nip therebetween through which a recording medium is conveyed under heat and pressure as the belt moves from the first roller toward the second roller in a longitudinal direction of the belt. The recording medium remains in contact with the belt cooled by the cooler during conveyance between the first roller and the second roller, and separates from the belt as the belt passes around the second roller. The belt tensioner is in contact with the belt to tension the belt in a transverse direction perpendicular to the longitudinal direction of the belt.

Other exemplary aspects of the present invention are put forward in view of the above-described circumstances, and provide an image forming apparatus incorporating a fixing device.

BRIEF DESCRIPTION OF THE SEVERAL VIEWS OF THE DRAWINGS

A more complete appreciation of the disclosure and many of the attendant advantages thereof will be more readily obtained as the same becomes better understood by reference to the following detailed description when considered in connection with the accompanying drawings, wherein.

DETAILED DESCRIPTION OF THE INVENTION

Figure 1:
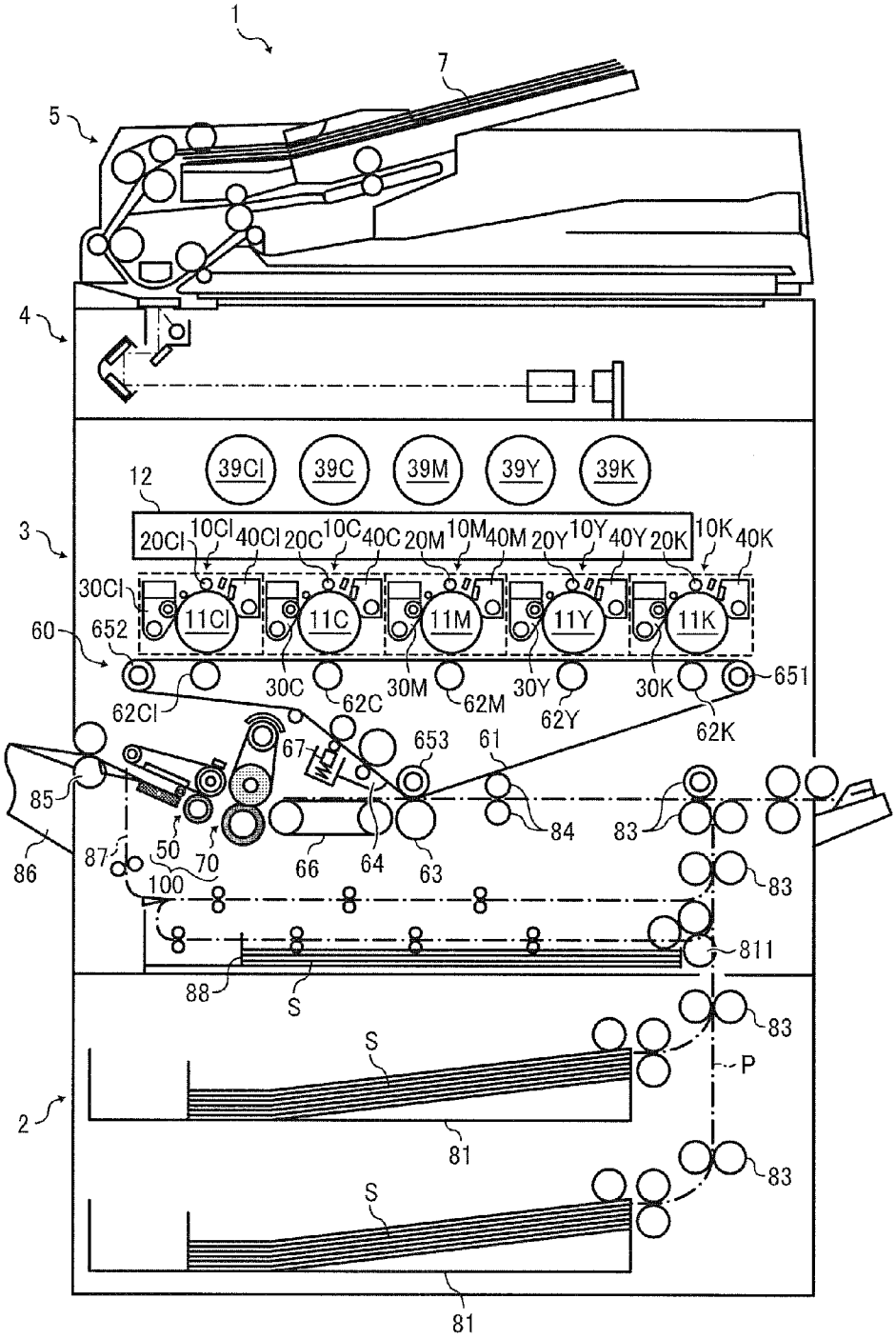
FIG. 1 schematically illustrates an image forming apparatus incorporating a fixing device according to one or more embodiments of the present invention.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, exemplary embodiments of the present patent application are described.

FIG. 1 schematically illustrates an image forming apparatus 1 incorporating a fixing device 100 according to one or more embodiments of this patent specification.

As shown in FIG. 1, the image forming apparatus 1 in the present embodiment includes a printing unit 3 at a central part of the apparatus body, above which an image scanner 4 for capturing information of an original image and an automatic document feeder (ADF) 5 for automatically feeding a user-supplied document to the scanner 4 are deployed one atop another, and below which is disposed a media conveyance unit 2 for supplying a recording medium such as a sheet of paper S to the printing unit 3.

In the image forming apparatus 1, the printing unit 3 comprises a tandem color printer including five imaging stations or process cartridges 10Cl, 10C, 10M, 10Y, 10K arranged in series generally horizontally above an intermediate transfer unit 60 and below an exposure unit 12, which together form an electrophotographic mechanism to form an image with toner particles on a recording sheet S for subsequent processing through the fixing device 100 located adjacent to the intermediate transfer unit 60.

The imaging stations (indicated collectively by the reference numeral 10) are of a similar configuration, each having a drum-shaped photoconductor 11 surrounded by a charging device 20 for charging the photoconductor surface to generate a latent image, a development device 30 for developing the latent image into a visible form using toner, a lubricant applicator for applying lubricant to the photoconductor surface, a blade-based cleaning device 40 for cleaning the photoconductive surface of residual toner, which work in cooperation to form a toner image of a particular color, as designated by the suffixes "C" for cyan, "M" for magenta, "Y" for yellow, and "K" for black, as well as "Cl" for a clear or transparent color. The imaging stations 10Cl, 10C, 10Y, 10M, and 10K are supplied with toner from toner bottles 39Cl, 39C, 39Y, 39M, and 39K, respectively, each of which is connected with the development device 30 through a suitable piping or conduit for transporting toner.

The imaging station 10 constitutes a process cartridge in which several pieces of imaging equipment, including at least the photoconductor 11 and the development device 30, are integrated into a single, integrated unit for removable installation into the image forming apparatus 1.

As described herein, the image forming apparatus 1 employ a colorless, clear toner in addition to toner of primary colors and black. The clear toner may be applied to a monochrome or multicolor toner image, so as to modify a surface configuration of the image in which the clear toner serves as an overcoat to protect the image surface. Also, the clear toner may be deposited in a suitable pattern on a smooth surface of a recording medium, which imparts a textured, fancy appearance to the resulting print adjustable by adjusting an amount of cleat toner deposited on a recording medium. Such surface modification or texturing effect of clear toner may be pronounced by superimposing a coating of clear toner atop layers of other, color toners, particularly where the clear toner is used in relatively large amount. It is to be noted, however, that superimposition of colorless and color toner images may be performed in a suitable order than specifically described herein depending on a specific configuration of the image forming apparatus 1.

The intermediate transfer unit 60 includes an intermediate transfer belt 61, five primary transfer rollers 62Cl, 62C, 62M, 62Y, and 62K, a secondary transfer roller 63, a belt cleaner 64, and a lubricant applicator 67, as well as multiple belt support rollers 651, 652, and 653 around which the intermediate transfer belt 61 is entrained to rotate clockwise in the drawing, passing through four primary transfer nips defined between the primary transfer rollers 62 and the corresponding photoconductive drums 11, as well as a secondary transfer nip defined between the belt support roller 653 and the secondary transfer roller 63.

The fixing device 100 includes a fixing unit 70 for semi-permanently fixing a toner image in place on a recording sheet S, and a glossing unit 50 for imparting gloss to the toner image after fixing. The fixing unit 70 includes a fuser member and a pressure member, one being internally heated by a suitable heater, such as a halogen heater or an electromagnetic induction heater, and the other being pressed against the internally heated member. A controller, such as a central processing unit (CPU) with associated memory devices, may be provided to optimize operation of the fixing device 100 by adjusting operational parameters depending on the type of recording medium used, and/or depending on the type of print job, such as full-color or monochrome, simplex or duplex, being executed. A detailed description of the fixing device 100 according to this patent specification will be given later with reference to FIG. 3 and subsequent drawings.

The media conveyance unit 2 includes multiple input sheet trays 81 each accommodating a stack of recording sheets S, a pair of registration rollers 84, a conveyor belt 66, a pair of discharge rollers 85, and an output sheet tray 86, as well as other conveyor and guide members 83 together defining a sheet conveyance path P along which a recording sheet S advances upward from the input tray 81 to undergo processing through the intermediate transfer unit 60 and then through the fixing device 100 to finally reach the output tray 86.

During operation, the printing unit 3 activates the imaging stations 10 to form a toner image on an outer surface of the intermediate transfer belt 61 according to image data obtained by decomposing an original color image into separate color components, which include yellow, magenta, cyan, and black, as well as a clear, transparent color.

Specifically, upon activation, each imaging station 10 rotates the photoconductor drum 11 counterclockwise in the drawing to forward its outer, photoconductive surface to a series of electrophotographic processes, including charging, exposure, development, transfer, and cleaning, in one rotation of the photoconductor dum 11.

First, the photoconductive surface is uniformly charged to a particular polarity by the charging device 20 and subsequently exposed to a modulated laser beam emitted from the exposure unit 12. The laser exposure selectively dissipates the charge on the photoconductive surface to form an electrostatic latent image thereon according to image data representing a particular primary color. Then, the latent image enters the development device which renders the incoming image visible using toner. The toner image thus obtained is forwarded to the primary transfer nip between the intermediate transfer belt 61 and the primary transfer roller 62.

At the primary transfer nip, the primary transfer roller 62 is supplied with a bias voltage of a polarity opposite that of the toner on the photoconductor drum 11. This electrostatically transfers the toner image from the photoconductive surface to an outer surface of the belt 61, with a certain small amount of residual toner particles left on the photoconductive surface. Such transfer process occurs sequentially at the four transfer nips along the belt travel path, so that toner images of different colors are superimposed one atop another to form a single multicolor image on the surface of the intermediate transfer belt 61.

After primary transfer, the photoconductor 11 enters the cleaning device 40 to remove residual toner from the photoconductive surface, followed by the discharging device removing residual charges from the photoconductive surface for preparation for a subsequent imaging cycle. At the same time, the intermediate transfer belt 61 forwards the multicolor image to the secondary transfer nip between the belt support roller 653 and the secondary transfer roller 63.

Meanwhile, in the media conveyance unit 2, the conveyor rollers introduce a recording sheet S from the input sheet tray 81 toward the pair of registration rollers 84 being rotated. Upon receiving the fed sheet S, the registration rollers 84 stop rotation to hold the incoming sheet S therebetween, and then advance it in sync with the movement of the intermediate transfer belt 61 to the secondary transfer nip. At the secondary transfer nip, the multicolor image is transferred from the belt 61 to the recording sheet S.

After secondary transfer, the intermediate transfer belt 61 advances to the belt cleaner 64 to remove residual toner from the belt surface, and then to the lubricant applicator to apply lubricant to the belt surface for preparation for a subsequent imaging cycle. At the same time, the recording sheet S bearing the powder toner image thereon is introduced into the fixing device 100 to fix the multicolor image in place on the recording sheet S with heat and pressure, followed by subsequent processing with heat and pressure through the glossing unit 50, which gives a high quality, glossy appearance to the resulting toner image.

Thereafter, the recording sheet S is ejected by the discharge rollers 85 to the output tray 86 for stacking outside the apparatus body, which completes one operational cycle of the image forming apparatus 1.

The image forming apparatus 1 may be configured to operate in multiple modes of operation as specified by a user submitting a print job.

For example, the image forming apparatus 1 may selectively operate in a monochrome mode using a single color, or in a full-color mode using multiple colors, depending on a user-specified print job. Thus, although the foregoing embodiment describes an example in which all the five imaging stations 10 are activated to form a full-color image with a clear, textured surface, the printing unit 3 may also form a monochrome image using a selected one of the multiple imaging stations 10, in particular, a black-and-white image using only the black imaging station 10K, as well as bi-color and tri-color images using two or more imaging stations 10 so selected, depending on a user-specified mode of operation in the image forming apparatus 1 is operated.

Also, the image forming apparatus 1 may selectively operate in a gloss-fixing mode in which a toner image is finished with an enhanced gloss, or in a normal fixing mode in which a toner image is processed without such gloss finishing, depending on a user-specified print job, or depending on the type of a recording medium S used in the specific print job. Thus, although the foregoing embodiment describes an example in which a toner image is fixed and then glossed through the fixing unit 70 and the glossing unit 50 of the fixing device 100, fixing may be accomplished without processing through the glossing unit 50, depending on a user-specified mode of operation in the image forming apparatus 1 is operated.

Figure 2:
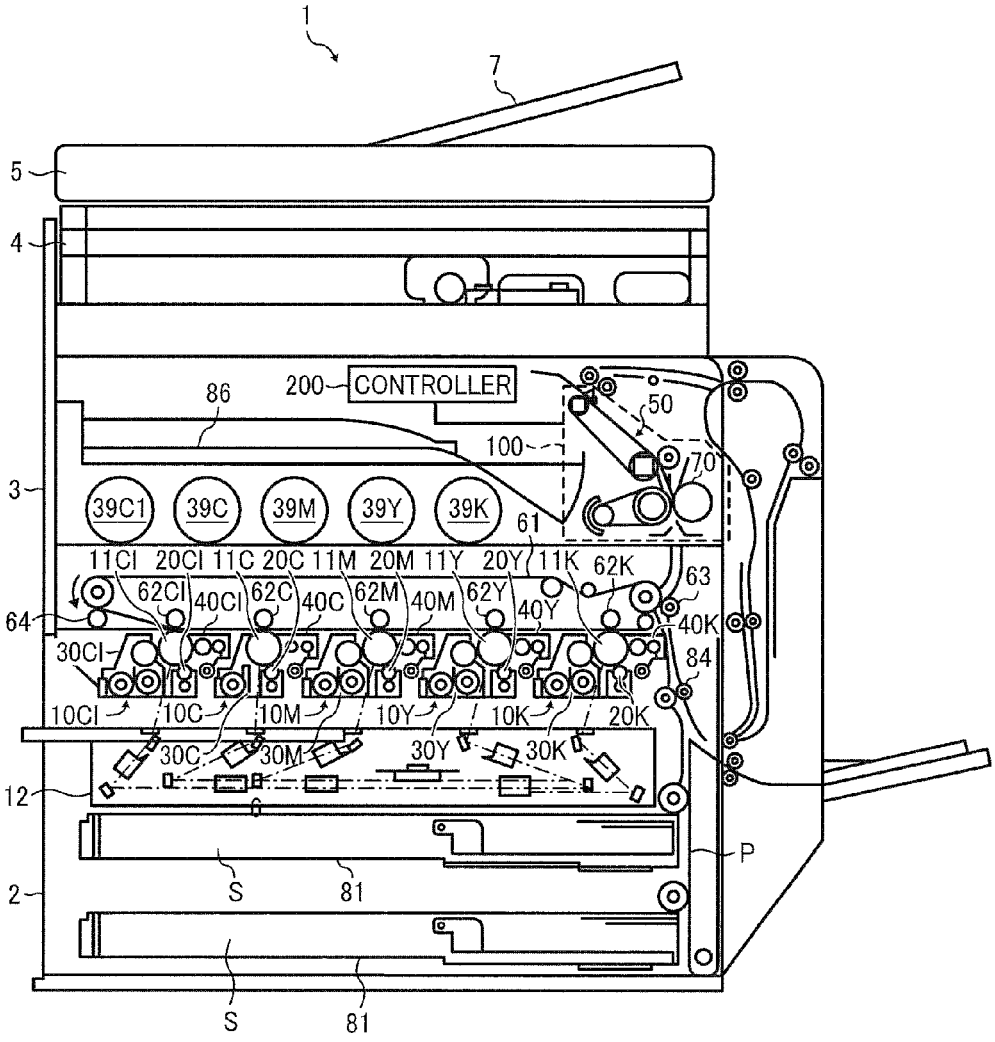
FIG. 2 schematically illustrates the image forming apparatus according to a further embodiment of the present invention.

In such cases, the fixing device 100 is configured to establish and de-establish a glossing nip defined between a heated roller and a pressure roller through which a recording medium S is passed to impart gloss to a toner image, so as to negate the glossing capability during operation in the normal fixing mode. Such switching of operation mode may be accomplished, for example, by providing a controller 200 to control a biasing mechanism of the glossing unit 50, as shown in FIG. 2.

More specifically, in the image forming apparatus 1 according to one or more embodiments of this patent specification, the photoconductor 11 is formed of amorphous silicon, metal, such as selenium, or an organic photosensitive material. For example, the photoconductor 11 may be an organic photosensitive element including a conductive supporting member upon which an inner, resin layer containing dispersed filler, an intermediate, photosensitive layer consisting of a charge generating layer and a charge transporting layer, and an outer, protective layer containing dispersed filler are deposited one upon another.

The photosensitive layer of the photoconductor 11 may be either of a monolayer structure that contains charge generating material and charge transporting material or of a laminate structure formed by combining a charge generating layer and a charge transporting layer. Although either configuration is possible, the laminate structure is superior to the monolayer structure in terms of optical sensitivity and durability.

The charge generating layer of the photoconductor 11 is fanned by dispersing charge generating pigments and binder resin in a suitable solvent using a ball mill, an attritor, a sand mill, an ultrasonic technique, or the like, and applying the solvent to the conductive supporting member, followed by drying the applied solvent. Examples of suitable binder resin for use in the charge generating layer include, but are not limited to, polyamide, polyurethane, epoxy resin, polyketone, polycarbonate, silicone resin, acrylate resin, polyvinyl butyral, polyvinyl formal, polyvinyl ketone, polystyrene, polysulfone, poly-N-vinyl carbazole, polyacrylamide, polyvinyl benzal, polyester, phenoxy resin, vinyl chloride-vinyl acetate copolymers, polyvinyl acetate, polyphenylene oxide, polyamide, polyvinylpyridine, cellulosic resin, casein, polyvinyl alcohol, and polyvinylpyrrolidone. The amount of the binder resin is from 0 to 500 parts by mass, preferably, from 10 to 300 parts by mass per 100 parts by mass of the charge generating material.

The charge transporting layer of the photoconductor 11 may be formed by resolving or dispersing a charge transporting material and a binder resin in a suitable solvent, and applying the solvent to the charge generating layer, followed by drying the applied solvent. The charge transporting material includes a hole transporting material and an electron transporting material. Examples of suitable binder resin for use in the charge transporting layer include, but are not limited to, a thermoplastic or thermosetting resin, such as polystyrene, styrene-acrylonitrile copolymer, styrene-butadiene copolymer, styrene-maleic anhydride copolymer, polyester, polyvinyl chloride, vinyl chloride-vinyl acetate copolymers, polyvinyl acetate, polyvinylidene chloride, polyarylate, phenoxy resin, polycarbonate, acetylcellulose resin, ethyl cellulose resin, polyvinyl butyral, polyvinyl formal, polyvinyl toluene, Poly(N-vinylcarbazole), acrylate resin, silicone resin, epoxy resin, melamine resin, urethane resin, phenol resin, and alkyd resin.

The protective layer may be optionally provided on the photosensitive layer of the photoconductor 11. Provision of the protective layer improves durability, leading to effective application of a highly sensitive and defectless photoconductor 11. Examples of suitable material for the protective layer include, but are not limited to, resin such as ABS resin, ACS resin, olefin-vinyl monomer copolymer, chlorinated polyether, allyl resin, phenol resin, polyacetal, polyamide, polyamide-imide, polyacrylate, polyallylsulfone, polybutylene, polybutylene terephthalate, polycarbonate, polyarylate, polyether sulfone, polyethylene, polyethylene terephthalate, polyimide, acrylate resin, polymethylpentene, polypropylene, polyvinylidene chloride, and epoxy resin, among which polycarbonate and polyarylate are preferable. In order to improve the abrasion resistance of the protective layer, it is possible to add a fluorine resin, such as polytetrafluoroethylene, a silicone resin, or a fluorine/silicone resin doped with a dispersed inorganic filler, such as titanium oxide, tin oxide, potassium titanate, or silica, or with a dispersed organic filler.

The concentration of filler in the outermost layer of the protective layer, although variable depending on the type of the filler or the electrophotographic processing conditions of the photoconductor 11, may be in a range of approximately 5% or greater by mass, preferably, from approximately 10% to approximately 50% by mass, and more preferably, from approximately 10% to approximately 30% by mass to the total amount of solid content dissolved therein.

Optionally, the photoconductor 11 may be equipped with a lubricant applicator. Such a lubricant applicator comprises a rectangular piece of solid lubricating agent accommodated in a case affixed to a surrounding structure, a brush roller rotatable in contact with the lubricant to scrape off a portion of lubricant for supply to the photoconductor 11, and a leveling blade held against the photoconductor 11 to level the layer of lubricant supplied to the photoconductive surface. A biasing spring is provided to bias the lubricant against the brush roller, which maintains the lubricant in secure contact with the brush roller where the lubricant thins down over time by being shaved off with the brush roller.

The charging device 20 includes a charging roller formed of a conductive core of metal covered by an outer layer of elastic material that exhibits a moderate electrical resistance which can generate ions when electrified. The charging roller 20 is connected to a power supply which supplies a predetermined direct current voltage (DC) and/or a predetermined alternating current voltage (AC) to the charging device. For example, the ion-discharging charging roller 20 may be of an elastic resin, and optionally contain an inorganic conductive material, such as carbon black, and an ionic conductor, for adjustment of electric resistance.

The charging roller 20 is positioned slightly spaced apart from the photoconductor 11. Such spacing is accomplished by, for example, a pair of spacer members of a suitable thickness wound around both ends of the charging roller 20 where the roller 20 faces a non-image forming area of the photoconductor 11, so that the spacer members are in contact with the surface of the photoconductive surface. Alternatively, instead, the charging roller 20 may touch the photoconductive surface. The charging device 20 in the shape of a roller positioned adjacent to the photoconductor 11 can selectively charge that portion of the photoconductive surface in the closest proximity with the ion-discharging surface. Provision of spacing between the charging device 20 and the photoconductor 11 prevents the charging device 20 from being soiled with residual toner. Optionally, the charging device 20 may be equipped with a cleaner roller that contacts the charging roller surface to clean it of any residues.

The development device 30 includes a development sleeve having a magnetic field generator in its interior, and defining a movable surface facing the photoconductor 10 upon which a developing agent, in this example, a two-component developer including magnetic career and toner, is carried toward the photoconductive surface to develop a latent image formed thereon.

The development device 30 also includes a mixing container equipped with a developer agitator or conveyor, such as a screw or auger, disposed below the development sleeve, in which developer is mixed with a supply of toner from the toner bottle 39 while agitated and conveyed toward the development sleeve as the screw rotates. A doctor blade or similar leveling device may be disposed adjacent to the development sleeve to regulate the thickness of developer carried on the surface of the sleeve. The development sleeve moves along with of the photoconductor drum 11 at the interface between the sleeve and photoconductive surfaces to cause toner to transfer from the sleeve surface to the photoconductive surface. A replaceable toner cartridge may be removably installed, for example, above the photoconductor 11, of the image forming apparatus 1, with a suitable transport mechanism, such as a Mohno pump or an air pump, connecting the cartridge and the developer container to replenish the development device 30 with new toner as desired during operation.

The cleaning device 40 includes a cleaning blade supported on a suitable holder to press against the photoconductor 11 to remove residual toner from the photoconductive surface. A computer-controlled actuator, operatively connected with a controller of the image forming apparatus 1, is provided to the cleaning device 40 to move the cleaning blade into contact with and away from the photoconductive surface as desired during operation. Directing the cleaning blade against a direction in which the photoconductive drum 11 rotates effectively removes residual toner as well as residues originating from a recording sheet, for example, additives such as talc, kaolin, and calcium carbonate, from the photoconductive surface. Contaminants removed from the photoconductive surface may be collected by a waste toner collecting coil into a waste toner container for future disposal by a service person or for recovery and recirculation into the development unit.

The intermediate transfer unit 60 includes the intermediate transfer belt 61 on which toner images are superimposed; primary transfer rollers 62 that transfer the toner images from the photoconductors 11 to the intermediate transfer belt 61 in a superimposed manner; and the secondary transfer roller 63 that transfers the superimposed toner images together onto the recording sheet S through the secondary transfer nip formed between the belt support roller 653 and the secondary transfer roller 63. The belt 61 may be equipped with the belt cleaner 64 to clean the belt surface after secondary transfer, and the lubricant applicator 67 to apply lubricant to the belt surface after cleaning. A computer-controlled actuator, operatively connected with a controller of the image forming apparatus 1, may be provided to move the belt support roller 653 into contact with and away from the intermediate transfer belt 61 as desired during operation.

More specifically, in the present embodiment, the intermediate transfer belt 61 comprises an endless belt formed of a substrate of heat-resistant material, such as polyimide or polyamide, formulated to exhibit a moderate electrical resistance or conductivity.

For example, the belt 61 may be a substrate of monolayer or laminate structure, formed of polyvinylidene fluoride (PVDF), ethylene tetrafluoroethylene (ETFE), polyimide (PI), polycarbonate (PC), or the like, with a conductive material, such as carbon black, dispersed therein to yield a volume resistivity ranging from $10^8$ to $10^{12}$ Ωcm and a surface resistivity ranging from $10^9$ to $10^{13}$ Ωcm.

Optionally, the belt substrate may be coated with a coating of release layer. Examples of suitable material for the release layer include, but are not limited to, fluorine resins such as ETFE, PVDF, polytetrafluoroethylene (PTFE), perfluoroalkoxy (PEA), tetrafluoroethylene-hexafluoropropylene copolymer (FEP), and polyvinylfluoride (PVF). The intermediate transfer belt 61 may be produced through molding, centrifugal molding, and the like. Where desired, the surface of the belt 61 may be polished.

As described herein, the intermediate transfer belt 61 is configured with its volume resistivity and surface resistivity falling within specific ranges. Too high a volume resistivity of the belt 61 leads to a costly power supply system due to an increased electrical bias required to transfer toner. Also, with an increased volume resistivity, the belt 61 is charged to an undesiredly high potential during transfer and upon separation of a recording medium from the belt surface, which makes it difficult for the belt 61 to discharge by itself, resulting in a need to provide an additional mechanism that assists in discharging the belt 61. On the other hands, too low a volume or surface resistivity of the belt 61, although allowing ready self-discharge of the belt 61 owing to accelerated attenuation of the voltage, can result in undesired sputtering of toner as it causes a current to flow along the belt surface during transfer.

The volume resistivity and surface resistivity of the belt 61 may be measured using a high-resistivity meter, model Hiresta Meter IP, available from Mitsubishi Chemical Analytech Co., Ltd. A dedicated probe, model HRS, also available from Mitsubishi Chemical Analytech Co., Ltd, having an inner electrode 5.9 mm in diameter and a ring electrode 11 mm in inner diameter, may be connected to the high-resistivity meter to measure the resistivity after 10 seconds since application of a voltage of 100 volts (for volume resistivity) and a voltage of 500 volts (for surface resistivity) across the thickness of the belt 61.

The lubricant applicator 67 for the intermediate transfer belt 61 comprises a rectangular piece of solid lubricating agent accommodated in a case affixed to a surrounding structure, a brush roller rotatable in contact with the lubricant to scrape off a portion of lubricant for supply to the intermediate transfer belt 61, and a leveling blade held against the belt 61 to level the layer of lubricant supplied to the belt surface. A biasing spring is provided to bias the lubricant against the brush roller, which maintains the lubricant in secure contact with the brush roller where the lubricant thins down over time by being shaved off with the brush roller.

The leveling blade of the lubricant applicator 67 is positioned in contact with the belt surface downstream from the lubricant in the direction of rotation of the belt 61. Such a leveling blade may be of an elastic piece of rubber directed against a direction in which the belt 61 moves, so as to clean the surface of the belt 61 while supplying the belt surface with lubricant.

Examples of solid lubricant for use in the lubricant applicator 67 include, but are not limited to, dried solid hydrophobic lubricant, such as zinc stearate, as well as metallic compounds including fatty acid groups, such as stearic acid, oleic acid, paltimic acid, or the like. Other examples include waxes, such as candelilla wax, carnauba wax, rice wax, vegetable wax, jojoba oil, beeswax, lanolin, and the like.

Each primary transfer roller 62 is disposed opposite the corresponding photoconductor 11 via the intermediate transfer belt 61 to form the primary transfer nip through which the toner image is primarily transferred from the photoconductive surface to the belt surface. The primary transfer roller 62 is connected to a power supply that charges the roller 62 with a predetermined direct current voltage (DC) and/or a predetermined alternating current voltage (AC) to a polarity opposite that of the toner image on the photoconductor 11, so as to electrically attract toner particles from the photoconductive surface to the belt surface across the primary transfer nip.

For adjustment of electrical resistance, the primary transfer roller 62 may be formed of a semi-conductor that contains an inorganic conductive material, such as carbon black, and an ionic conductor. The efficiency with which toner is transferred is unaffected by the resistance of the primary transfer roller 62, but is largely dependent on the image area ratio, so that variations in the image area ratio adversely affect stable transfer performance. For example, where an image contains an extremely small image area relative to a background area, electrification of the primary transfer roller 62 causes more electricity to flow into the background area than into the image area, resulting in a reduced transfer voltage and insufficient transfer field.

Adverse effects of variations in the image area ratio are pronounced where the primary transfer roller 62 exhibits a relatively low resistance, since in such cases the transfer performance is more significantly influenced by the resistance of toner present at the primary transfer nip. Thus, for stabilizing transfer performance using a constant current control, it is desirable that the primary transfer roller 62 exhibit a sufficiently high electrical resistance, although too high a resistance of the primary transfer roller 62, such as exceeding $5*10^8$Ω, may induce a leak current that is detrimental to image quality. For example, the resistance of the primary transfer roller 62 may be set in a range of from approximately $5*10^8\Omega$ to approximately $1*10^8\Omega$ to effectively prevent defects from the influence of the resistance of toner at the primary transfer nip.

Additionally, adverse effects of variations in the image area ratio are also pronounced where the potential difference between the primary transfer roller 62 (or more precisely, the voltage applied to the conductive metal core of the roller 62) and the photoconductor 11 is greater in a background area than in an image area, so that electricity flows more readily into the background area than into the image area. Such is the case with a configuration in which the toner is attracted to those portions of the photoconductive surface discharged by exposure to form a toner image, and in which the toner image is charged to the same polarity as that of the photoconductive surface. That is, with the primary transfer voltage being of a polarity opposite that of the photoconductor voltage, the difference between the primary transfer voltage and the photoconductor voltage is higher in the background area than in the image area where the photoconductive surface exhibits a higher potential in the background area than in the image area. For example, the resistance of the primary transfer roller 62 may be set in a range of from approximately $5*10^7\Omega$ to approximately $5*10^8\Omega$ to prevent defects due to the difference between the primary transfer voltage and the photoconductor voltage.

The secondary transfer roller 63 is disposed opposite the belt support roller 653 via the intermediate transfer belt 61 to form the secondary transfer nip through which the toner image is secondarily transferred from the belt surface to the recording sheet S. As is the case with the primary transfer roller 62, the secondary transfer roller 63 is connected to a power supply that charges the roller 62 with a predetermined direct current voltage (DC) and/or a predetermined alternating current voltage (AC) to a polarity opposite that of the toner image on the intermediate transfer belt 61, so as to electrically attract toner particles from the belt surface to the recording sheet S across the secondary transfer nip.

The secondary transfer roller 63 is foamed of a cylindrical core of metal covered by an inner elastic layer and an outer surface layer of resin material deposited one upon another. The cylindrical metal core of the roller 63 may be formed of conductive metal, such as stainless steel and aluminum. The elastic layer of the roller 63 is configured to exhibit a certain hardness or elasticity required to properly establish a secondary transfer nip by deforming the roller 63 against the backup roller 653. To ensure proper formation of the secondary transfer nip, the elastic layer of the roller 63 may be formed of rubber that exhibits a hardness as defined in the Japanese Industrial Standards for civil engineering and architecture (JIS-A), of approximately 70° or smaller.

The secondary transfer roller 63 may be equipped with a cleaning blade that contacts the roller 63 at a constant contact angle to remove residues from the roller surface. In such cases, excessive elasticity of the roller 63 would affect proper, stable positioning of the cleaning blade against the roller 63. To ensure proper performance of the cleaning blade, the elastic layer of the roller 63 may be formed of rubber that exhibits a hardness, as defined in JIS-A, of approximately 40° or greater.

The elastic layer of the secondary transfer roller 63 is required to conduct electricity because an insulator would not properly function to transfer a toner image to a recording medium. For example, the elastic layer of the roller 63 may be formed of foamed resin, approximately 2 to approximately 10 mm in thickness, with a conductive additive formulated to enhance electrical conductivity of the roller 63. Examples of suitable material for the elastic layer include, but are not limited to, ethylene propylene diene monomer M-class (EPDM) rubber or silicone rubber with a dispersion of carbon black, nitrile butadiene rubber (NBR) having ion conductivity, and urethane rubber.

The surface layer of the secondary transfer roller 63 is required to exhibit a low coefficient of friction and good releasability of toner, so as to compensate for a relatively large coefficient of friction and a relatively large affinity with toner, which ensures good functioning of the roller 63 in contact with the cleaning blade 22. For example, the surface layer of the roller 63 may be formed of fluorine resin with a suitable additive added to control resistivity of the resin layer.

The surface layer of the secondary transfer roller 63 is also required to exhibit low friction against the intermediate transfer belt 61, since any slight difference in linear speed between the surfaces of the intermediate transfer belt 61 and the secondary transfer roller 63 moving in contact with each other would adversely affect proper rotation of the belt 61, leading to malfunctioning of the intermediate transfer unit 60. For example, the surface layer of the roller 63 may be configured to exhibit a frictional coefficient of approximately 0.4 or smaller against the intermediate transfer belt 61.

The developer used in the image forming apparatus 1 may be of any suitable developing agent, including a two-component developer as well as a single component developer, either magnetic or non-magnetic. In case a two-component developer is employed, such a developer may contain a carrier content of approximately 90% to approximately 98% by weight, and preferably, of approximately 93% to approximately 97% by weight.

The magnetic carrier used in the image forming apparatus 1 may be formed of a magnetic particle core covered by a coating of non-magnetic binder resin with a charge control agent added to control electrical charge of the binder resin. Any known or future-developed magnetic material may be employed to prepare the particle core, such as, for example, iron powder, ferrite powder, magnetite powder, and the like. Also, any known or future-developed binder material may be employed to prepare the coating on the particle core, such as, for example, silicone resin. The core particle of the carrier may be formed with a volume-average diameter of approximately 10 μm to approximately 50 μm, and preferably, of approximately 20 μm to approximately 80 μm.

The toner included in the developer for use in the image forming apparatus 1 may be produced through either a pulverization or polymerization process. In a pulverization process, for example, a batch of material, including binder resin, colorant, wax, and the like, is mixed and sheared at an elevated temperature to create a kneaded mass in which the colorant and wax contents are dispersed into the binder resin. The kneaded mixture is then milled and cooled into a rigid, planar block, which is then pulverized into smaller particles. The particles thus produced are classified to obtain a particulate material with a desired particle-size distribution, followed by adding other additives to the powder to obtain toner.

The binder resin for use in the image forming apparatus 1 may be a polyester resin that may be fused at a relatively low processing temperature. Such a polyester resin may be employed in combination with another, non-polyester resin insofar as the addition of non-polyester resin does not adversely affect characteristics of resulting toner. Examples of suitable non-polyester resin include, but are not limited to, polystyrene, chloropolystyrene, poly-α-methylstyrene, styrene-chlorostyrene copolymer, styrene-propylene copolymer, styrene-budadiene copolymer, styrene-acrylic acid ester copolymer, styrene methacrylic acid ester copolymer, epoxy resin, polyethylene resin, polypropylene resin, and ionomer resin. The resins recited herein may be used alone or in combination. Also, these resins may be produced through any suitable production technique, including bulk, solution, emulsion, and suspension polymerization techniques.

Any known or future-developed coloring agent may be employed to prepare the toner. Examples of suitable colorant include, but are not limited to, carbon black, lamp black, iron black, aniline blue, Phthalocyanine Blue, Phthalocyanine Green, Hansa Yellow Rhodamine 6C Lake, chalco Oil Blue, chrome yellow, quinacridone, Benzidine Yellow, Rose Bengal, and triallylmethane dyes. The dyes recited herein may be used alone or in combination to obtain toners of specific primary colors as well as black toner. The toner may contain a suitable content of such colorant, preferably from approximately 1% to approximately 30% by weight, and more preferably from approximately 3% to approximately 20% by weight per 100% by weight of the resin content. The clear toner may be prepared with a composition similar to that depicted above, except that production of clear toner does not involve addition of coloring agent.

Where desired, the toner may contain a charge control agent. Any known or future-developed charge control agent may be employed, such as, for example, nigrosin dyes, metal complex dyes, quaternary ammonium salt, in mixture with a zirconium-based compound. The toner may contain a suitable content of such charge control agent, preferably from approximately 0.1 parts to approximately 30 parts by weight, and more preferably from approximately 1 part to approximately 5 parts by weight of the resin content.

Figure 3:
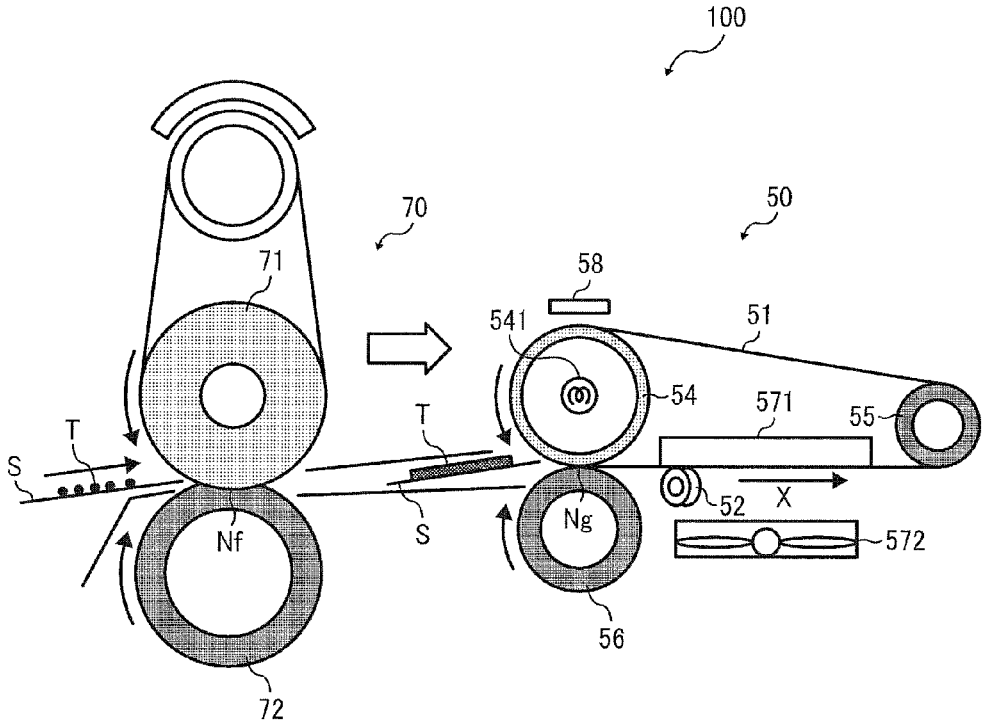
FIG. 3 is an end-on, axial view of the fixing device according to one or more embodiments of this patent specification.

FIG. 3 is an end-on, axial view of the fixing device 100 according to one or more embodiments of this patent specification.

As shown in FIG. 3, the fixing device 100 includes a primary, fixing unit 70 to fix a toner image semi-permanently in place on a recording sheet S conveyed along a sheet conveyance path, and a secondary, glossing unit 50 disposed downstream from the fixing unit 70 along the sheet conveyance path to process the toner image with heat and pressure, so as to impart gloss to the resulting print on the recording sheet S.

In the fixing device 100, the fixing unit 70 comprises a pair of rotary fixing members, at least one of which is heated, and at least one of which is pressed against the other. In the present embodiment, for example, the fixing unit 70 includes an internally heated fuser roller 71 paired with a pressure roller 72 pressed against the fuser roller 71 to form a fixing nip Nf therebetween. Any suitable type of heating mechanism may be employed to heat the fuser roller 71, such as, for example, a radiant, halogen lamp or an electromagnetic induction heater, depending on specific configurations of the fixing process.

The glossing unit 50 includes a first, heat roller 54; a second, stripper roller 55 parallel to the first roller 54; a smooth, endless belt 51 looped for rotation around the first and second rollers 54 and 55; a third, pressure roller 56 opposite the first roller 54 via the belt 51; a heater 541 in the first roller 54 to heat the roller 54 to in turn heat the belt 51; a cooler 571 inside the loop of the belt 51 between the first and second rollers 54 and 55 to cool the belt 51; and a belt tensioner 52 in contact with the belt 51.

Also included in the glossing unit 50 are an auxiliary cooler 572 outside the loop of the belt between the first and second rollers 54 and 55 to assist cooling along the belt 51; and a non-contact temperature detector or thermometer 58 adjacent to the heat roller 54 outside the loop of the belt 51 to measure temperature at the outer circumferential surface of the belt 51.

The first and third rollers 54 and 56 press against each other to form a glossing nip Ng therebetween through which a recording sheet S is conveyed under heat and pressure as the belt 51 moves from the first roller 54 toward the second roller 55 in a longitudinal direction X of the belt 51. The recording sheet S remains in contact with the belt 51 cooled by the cooler 571 during conveyance between the first roller 54 and the second roller 55, and separates from the belt 51 as the belt 51 passes around the second roller 55.

Specifically, in the glossing unit 50, the first, heat roller 54 comprises a cylindrical body of thermally conductive material, such as aluminum, stainless steel, iron, or the like, approximately 30 mm to approximately 90 mm in diameter. An optional, coating layer of elastic material, such as silicone rubber or the like, approximately 0.5 mm to approximately 5 mm thick, may be provided on an outer circumferential surface of the heat roller 54 to provide an increased area of contact between the opposed rollers 54 and 56 at the fixing nip Nf.

The endless belt 51 comprises a flexible belt of heat-resistant resin or metal, approximately 10 μm to approximately 200 μm in thickness, and approximately 80 mm to approximately 300 mm in diameter in its generally cylindrical configuration. Examples of suitable belt material include, but are not limited to, polyimide, nickel, stainless steel, or the like. An optional, coating layer of elastic material, such as silicone rubber or the like, approximately 5 μm to approximately 50 μm thick may be provided on an outer circumferential surface of the belt 51 for allowing close, uniform contact with the printed surface of the recording sheet S conveyed on the belt surface. Also, an outermost surface of the belt 51 may be provided with a coating of release agent, such as silicone or fluorine resin, for providing ready separation of the recording sheet S from the belt 51.

The second, stripper roller 55 comprises a cylindrical body of suitable material, such as iron, aluminum, stainless steel, or the like, approximately 10 mm to approximately 30 mm in diameter.

The third, pressure roller 56 comprises a cylindrical body approximately 30 mm to approximately 90 mm in diameter, consisting of a cylindrical core of suitable material, such as iron, aluminum, stainless steel, or the like, covered with an outer layer of elastic material, such as fluorine rubber, silicone rubber, or the like, approximately 1 mm to approximately 50 mm thick, deposited on the cylindrical core.

The pressure roller 56 is equipped with a suitable biasing mechanism formed, for example, of a rotary actuator connected to the roller rotational axis through a cam, which allows the pressure roller 56 to move relative to the belt 51 and the heat roller 54, so as to adjust width and strength of the fixing nip Nf determined by relative positions of the rotational axes of the opposed rollers 54 and 56.

The pressure roller 56 is also equipped with a suitable rotary driver motor connected to the roller rotational axis, which drives the roller 56 to rotate to in turn rotate the heat roller 54 as well as the belt 51 and the stripper roller 55.

The heater 541 comprises any suitable heat source that generates an amount of heat sufficient to melt and fuse toner accommodated in the fixing device 100. In the present embodiment, for example, the heater 541 is a halogen heater disposed inside the heat roller 54 to radiate heat to an inner circumferential surface of the heat roller 54, from which heat is imparted to the belt 51 entrained around the heated roller 54. Operation of the heater 541 is computer-controlled according to readings of the thermometer 58 so as to maintain the belt surface at a desired operational temperature.

The cooler 571 comprises a cooling jacket formed of metal with high thermal conductivity, such as aluminum, copper, stainless steel, or the like in any suitable configuration, such as a fin for air-cooling with a mechanical fan, or a tube or pipe containing water or any suitable coolant fluid, which absorbs heat from a heated surface in direct contact with the cooling jacket. Alternatively, instead, the cooler 571 may be a non-contact cooling mechanism, such as an air-cooling fan, which removes heat by directing airflow to a heated surface.

In the present embodiment, for example, the cooler 571 is a liquid cooling jacket that contacts and slides against the inner circumferential surface of the looped belt 51 to cool the belt 51 moving from the first roller 54 toward the second roller 55. Compared to fanning or blowing air on the belt inner circumferential surface, using such a contact cooler provides good efficiency in cooling the belt owing to high heat capacity of the cooling jacket.

The auxiliary cooler 572 comprises any suitable cooling mechanism, such as a non-contact cooling mechanism, such as an air-cooling fan, which removes heat by directing airflow to a heated surface.

During operation, after image formation through an electrophotographic imaging unit according to a print request in a manner as described above with reference to FIG. 1, a recording sheet S bearing an unfixed toner image T thereon enters the fixing unit 70.

In the fixing unit 70, the incoming sheet S passes through the fixing nip Nf between the opposed rollers 71 and 72, which melts and fuses toner with heat from the fuser roller 71 and pressure from the pressure roller 72, resulting in the toner image T semipermanently fixed in place on the recording sheet S. After fixing, the recording sheet S proceeds to the glossing unit 50.

In the glossing unit 50, the incoming sheet S initially passes through the glossing nip Ng between the opposed rollers 54 and 56 along the rotating belt 51, which re-melts the once-fixed toner image T with heat from the heat roller 54 and pressure from the pressure roller 56. The recording sheet S after passing through the glossing nip Ng is conveyed with its printed surface contacting the belt surface, as the belt 51 moves from the heat roller 54 toward the stripper roller 55 in the longitudinal direction X of the belt 51.

The belt 51 traveling between the rollers 54 and 55 is cooled by the cooler 571 from inside the loop of the belt 51. Cooling the belt 51 with the cooler 571 in turn cools the printed surface of the recording sheet S, whereas the other, unprinted surface of the recording sheet S is cooled by the auxiliary cooler 572 from outside the loop of the belt 51. As the recording sheet S is thus cooled from both sides, the re-molten toner T contacting the belt surface solidifies to assume a smooth, uniform surface in conformity with the smooth circumferential surface of the belt 51. Such conforming of toner to the smooth belt surface, combined with increased surface tension of toner during solidification, results in greater smoothness of the toner image which imparts greater gloss to the printed surface of the recording sheet S.

After solidification along the belt 51 cooled downstream from the glossing nip Ng, the recording sheet S is forwarded to around the stripper roller 55, whereby the sheet S self-strips from the belt surface due to curvature of the stripper roller 55, and then exits the glossing unit 70.

As mentioned earlier, the fixing device 100 according to this patent specification includes the glossing unit 50 provided with the belt tensioner 52 in contact with the endless belt 51. The belt tensioner 52 serves to tension the belt 51 in a transverse direction Y perpendicular to a longitudinal direction X of the belt 51. Provision of the belt tensioner 52 prevents loosening, bending, creasing, or other undesired deformation of the belt 51, so that the belt 51 can remain in proper, close contact or proximity with the cooler 571. A description is now given of several examples of such belt tensioning mechanism and its associated structure according to several embodiments of this patent specification, with reference to FIG. 4 and subsequent drawings.

Figure 4:
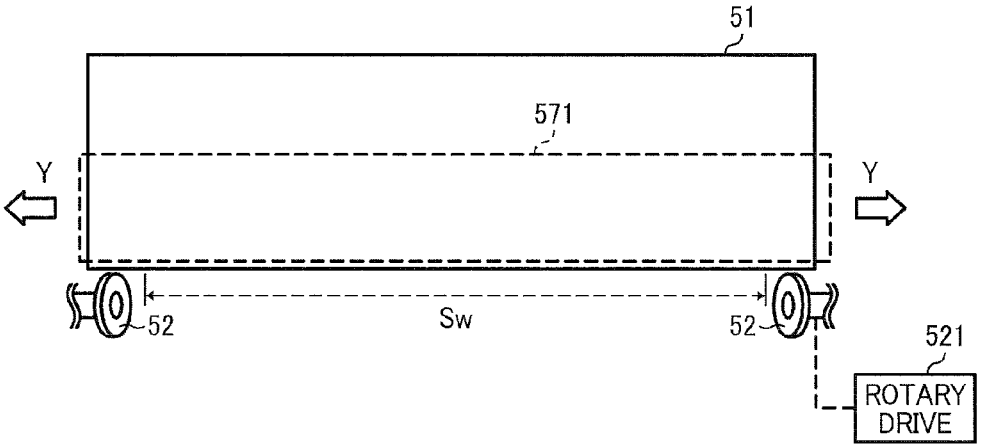
FIG. 4 is a rear elevational view of an endless belt provided with a belt tensioner according to a first embodiment of this patent specification.
Figure 5:
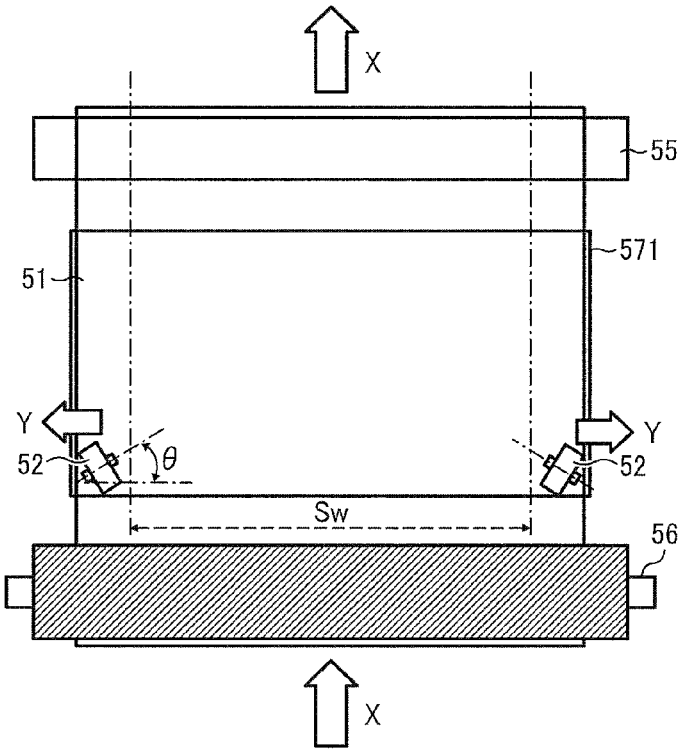
FIG. 5 is a bottom plan view of the endless belt of FIG. 4.

FIGS. 4 and 5 are rear elevational and bottom plan views, respectively, of the endless belt 51 provided with the belt tensioner 52 according to a first embodiment of this patent specification.

As shown in FIGS. 4 and 5, the belt tensioner 52 in the present embodiment comprises a pair of rotary members disposed at opposed edges of the belt 51 outboard a width Sw of the recording sheet S accommodated in the fixing device 100, facing an upstream end of the cooler 571 in the longitudinal direction Y of the belt 51.

During operation, as the belt 51 rotates around the rollers 54 and 55, the tensioner wheels 52 rotate in contact with the moving surface of the rotating belt 51, while slipping over the belt surface in the transverse direction Y. Such rotation and slipping of the tensioner wheels 52 forces the belt 51 outward toward the belt edges as well as normal to the belt surface, thereby generating a tension that counteracts any tendency of the belt to loosen, sag, or crease during rotation around the rollers 54 and 55.

Compared to a stationary rib held in contact with the belt surface, which may be also contemplated for use as a belt tensioner, using the rotatable wheel 52 to tension the belt 51 in the transverse direction Y does not cause substantial friction between the tensioner and belt surfaces, and hence allows for proper, stable operation of the belt rotating around the rollers 54 and 55.

In the present embodiment, the rotary tensioner member 52 comprises a wheel having a diameter of approximately 10 mm to approximately 40 mm, and formed of a suitable material, such as aluminum, stainless steel, iron, or heat-resistant resin. Optionally, the tensioner wheel 52 may have an outer surface thereof coated with silicone or butyl rubber for obtaining sufficient friction between the tensioner and belt surfaces. An axle of the wheel 52 may be supported on a surrounding structure of the glossing unit 50.

The tensioner wheel 52 may be oriented outward with its rotational axis angled with respect to the transverse direction Y of the belt 51 between the first roller 54 and the second roller 55. Also, the tensioner wheel 52 may have its rotational axis angled with respect to a surface of the belt 51 between the first roller 54 and the second roller 55.

Specifically, with particular reference to FIG. 5, the tensioner wheel 52 is shown with an angle θ between the wheel rotational axis and an imaginary line parallel to the transverse direction Y of the belt 51. The angle θ may be in a range of from approximately 5 degrees to approximately 45 degrees, and preferably, from approximately 10 degrees to approximately 20 degrees. The rotational axis of the wheel 52 may be positionable relative to the transverse direction Y, so as to adjust the angle θ depending on the tendency of the belt 51 to loosen during rotation around the rollers 54 and 55.

Figure 6:
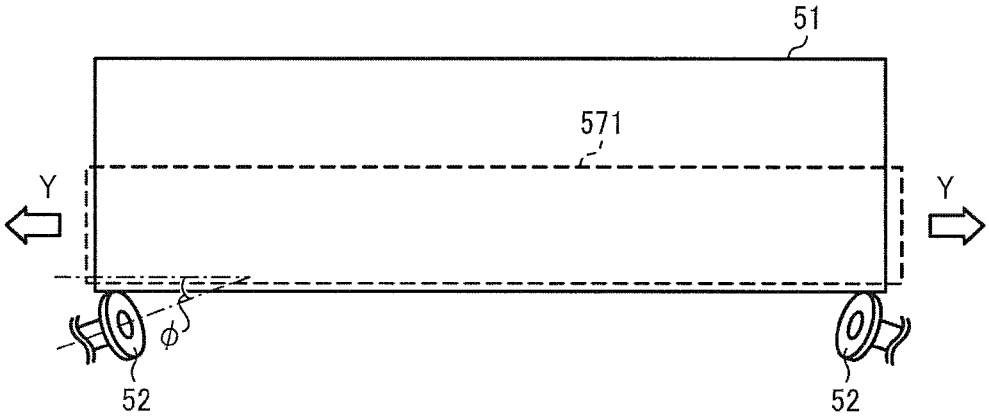
FIG. 6 is another rear elevational view of the endless belt of FIG. 4.

With additional reference to FIG. 6, the tensioner wheel 52 is shown with an angle ϕ between the wheel rotational axis and an imaginary line parallel to the surface of the belt 51 between the first roller 54 and the second roller 55. The angle ϕ may be determined depending on the tendency of the belt 51 to loosen during rotation around the rollers 54 and 55, such as, for example, 0 degree, in which case the belt surface is tangent to the tensioner wheel 52.

Positioning the tensioner wheel 52 with suitable angles or inclination of its rotational axis facilitates adjustment of tension exerted by the wheel 52 on the endless belt 51, leading to more effective protection against loosening of the belt 51.

Further, the tensioner wheel 52 may be pressed against the cooler 571 via the belt 51. Pressing the tensioner wheel 52 against the cooler 571 enables the belt tensioner 52 to generate a sufficient, consistent tension in the belt 51, leading to more effective protection against loosening of the belt 51 with the belt tensioner 52. Alternatively, however, it may also be possible to position the tensioner wheel 52 without facing or pressing against the cooler 571 via the belt 51, in which case the resulting belt tension can be extremely small and smaller than that obtained where the tensioner wheel 52 is pressed against the cooler 571.

Still further, the tensioner wheel 52 may be provided with a rotary drive motor 521 connected to the wheel axle to rotate the tensioner wheel 52. In this case, the tensioner wheel 52 may be rotated at a rotational speed higher than that of the belt 51. Provision of the rotary drive 521 reduces friction between the tensioner and belt surfaces which resists movement of the belt 51 in the longitudinal direction X, leading to a reduced torque required to drive the belt 51 around the rollers 54 and 55 during operation.

Figure 7:
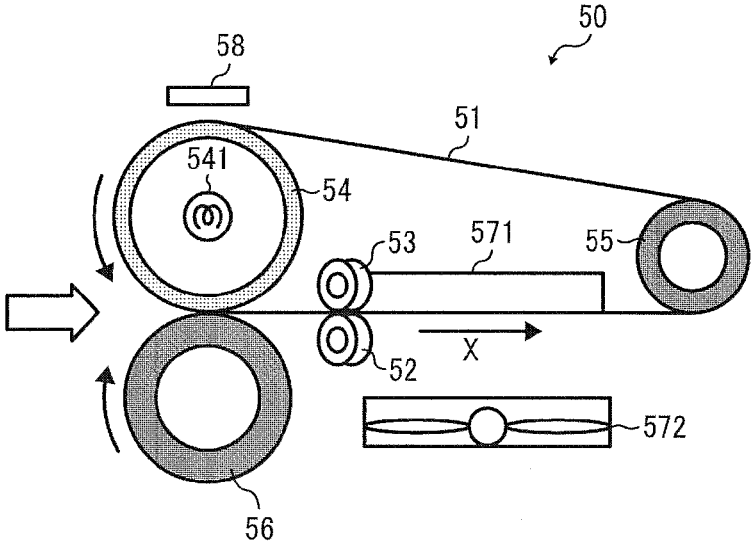
FIG. 7 is an end-on, axial view of the fixing device according to a second embodiment of this patent specification.

FIG. 7 is an end-on, axial view of the fixing device 100 including the belt tensioner 52 according to a second embodiment of this patent specification.

As shown in FIG. 7, the overall configuration of the second embodiment is similar to that depicted in FIG. 3, except that the belt tensioner 52 is provided with a backing member 53 inside the loop of the belt 51 between the first and second rollers 54 and 55, against which the rotary tensioner member 54 is pressed via the belt 51.

Figure 8:
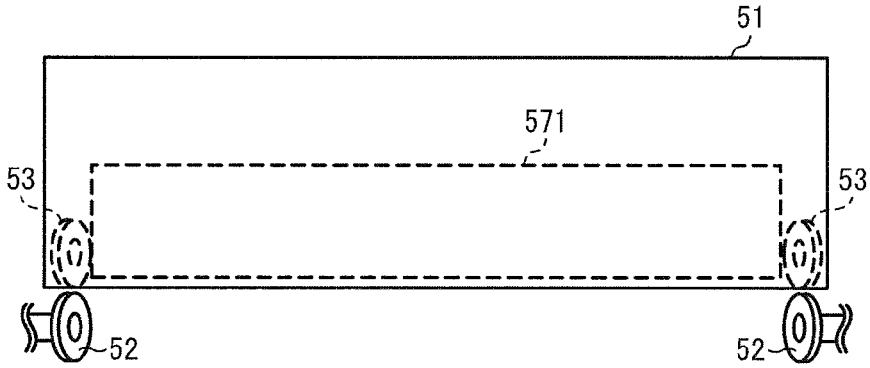
FIG. 8 is a rear elevational view of an endless belt provided with a belt tensioner included in the fixing device of FIG. 7.
Figure 9:
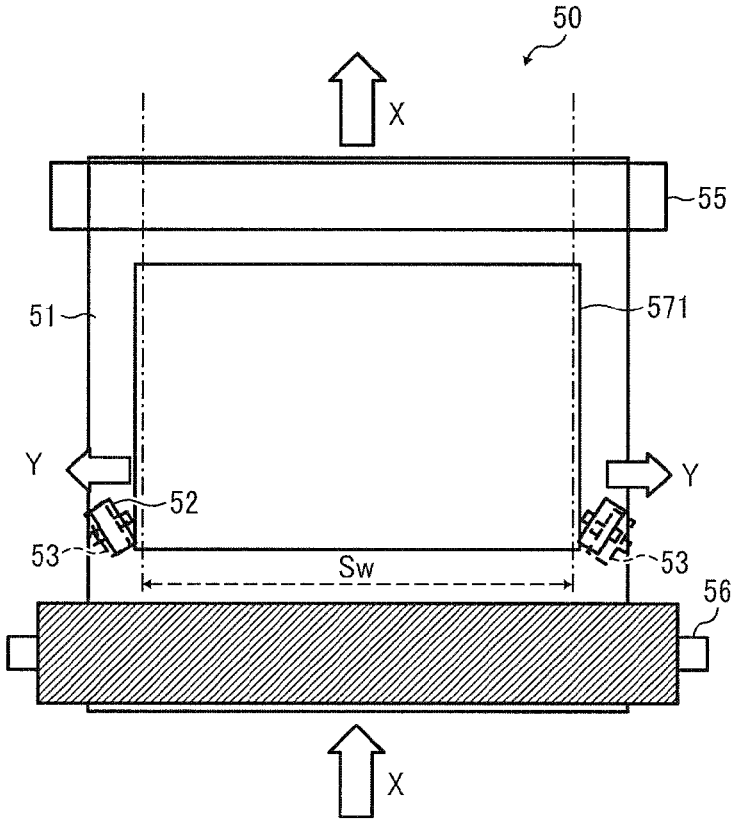
FIG. 9 is a bottom plan view of the endless belt of FIG. 8.

With additional reference to FIGS. 8 and 9, the belt tensioner 52 in the present embodiment comprises a pair of rotary members or wheels disposed at opposed edges of the belt 51 outboard a width Sw of the recording sheet S accommodated in the fixing device 100, as is the case with the first embodiment. The width of the cooler 571 in the transverse direction Y is dimensioned so that the tensioner wheel 52 adjoins, but does not overlap, an upstream end of the cooler 571 in the longitudinal direction Y of the belt 51.

The backing member 53 comprises a rotary member or wheel disposed opposite the tensioner wheel 52, so that the opposed rotary members 52 and 53 are pressed against each other via the belt 51. Although it is also possible to use a stationary backing member instead of a wheel to support pressure from the belt tensioner 52 via the belt 51, the rotary backing member 52 serves the intended purpose without causing excessive friction on the belt surface, which would otherwise result in accelerated wear and tear and/or unstable operation of the belt 51 conveying a recording sheet S.

During operation, as the belt 51 rotates around the rollers 54 and 55, the tensioner wheels 52 and the backing wheels 53 rotate together in contact with the moving surfaces of the rotating belt 51, while slipping over the belt surface in the transverse direction Y Such rotation and slipping of the wheels 52 and 53 forces the belt 51 outward toward the belt edges as well as normal to the belt surface, thereby generating a tension that counteracts any tendency of the belt to loosen, sag, or crease during rotation around the rollers 54 and 55.

As is the case with the preceding embodiment, the tensioner wheel 52 may be oriented outward with its rotational axis angled with respect to the transverse direction Y of the belt 51 between the first roller 54 and the second roller 55. In such cases, the backing wheel 53 may be oriented in a similar direction as that of the tensioner wheel 52, so that the opposed wheels 52 and 53 are parallel to each other. The angle of rotational axis as well as the pressure between the rotary members 52 and 53 may be adjusted depending on the tendency of the belt 51 to loosen during rotation around the rollers 54 and 55.

In the present embodiment, at least one of the tensioner wheel 52 and the backing wheel 53 may be provided with a rotary drive motor connected to the wheel axle to rotate the tensioner wheel 52. In this case, the motor-driven rotary wheel may be rotated at a rotational speed higher than that of the belt 51. Provision of the rotary driver reduces friction between the tensioner and belt surfaces which resists movement of the belt 51 in the longitudinal direction X, leading to a reduced torque required to drive the belt 51 around the rollers 54 and 55 during operation.

Providing the backing member 53 to support pressure from the belt tensioner 52 enables the belt tensioner 52 to generate a sufficient, consistent tension in the belt 51, leading to more effective protection against loosening of the belt 51 with the belt tensioner 52. The backing member 53 in the form of an opposed wheel does not cause substantial friction between the tensioner and backing surfaces, resulting in a reduced torque required to drive the belt 51, compared to that required where the tensioner wheel 52 is pressed against the cooler 571.

Moreover, provision of the backing member 53 separate from the cooler 571 allows for use of a non-contact cooler, such as a fan, instead of a contact cooler, inside the loop of the belt 51 to cool the belt 51, leading to greater flexibility in the design of the fixing device 100. In such cases, pressing the belt 51 between the opposed wheels 52 and 53 allows for stretching the belt 51 independently in the transverse direction Y of the belt 51, which effectively prevents undesired creases in the belt 51, leading to good glossing performance of the fixing device 100.

Figure 10:
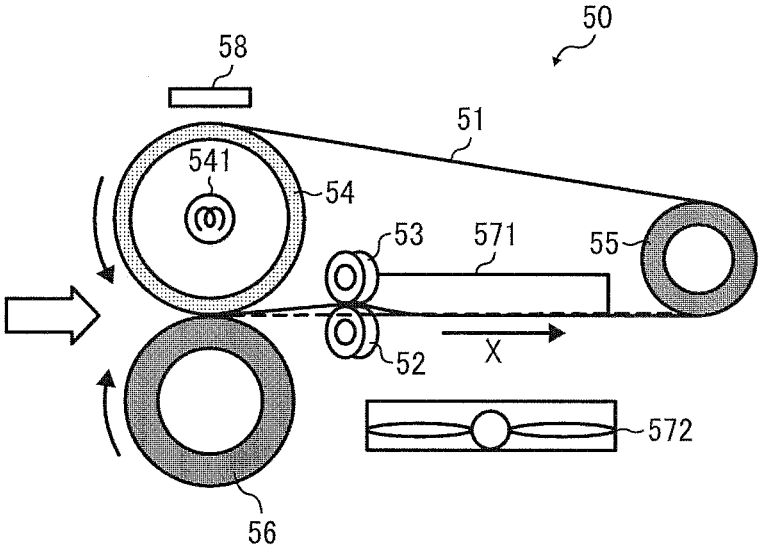
FIG. 10 is an end-on, axial view of the fixing device according to a third embodiment of this patent specification.
Figure 11:
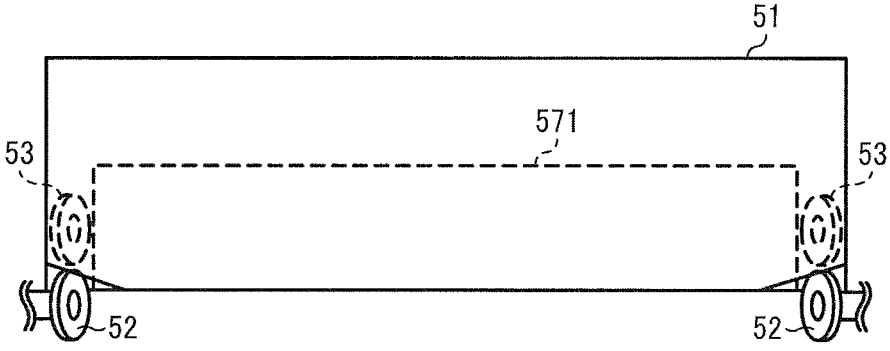
FIG. 11 is a rear elevational view of an endless belt provided with the belt tensioner included in the fixing device of FIG. 10.

FIG. 10 is an end-on, axial view of the fixing device 100 according to a third embodiment of this patent specification, and FIG. 11 is a rear elevational view of the endless belt 51 provided with the belt tensioner 52 included in the fixing device 100 of FIG. 10.

As shown in FIGS. 10 and 11, the overall configuration of the third embodiment is similar to that depicted in FIG. 7. Unlike the second embodiment, however, the opposed wheels 52 and 53 in the present embodiment form a nip therebetween that is not flush with, but is recessed from, the surface of the cooler 571 in contact with the belt 51. That is, an interfacial plane between the belt tensioner 52 and the backing member 53 is offset toward the cooler 571 with respect to an interfacial plane between the cooler 571 and the belt 51.

Such arrangement allows the belt tensioner 52 to more firmly tighten the belt 51 in the transverse direction Y, resulting in more effective protection against loosening of the belt 51 than is possible without the offset between the interfacial planes. High protection against loosening enables the belt 51 to maintain more close contact or proximity with the cooler 571, thereby increasing efficiency in cooling the belt 151 with the belt cooler 571, leading to uniform heat distribution across the belt 51 which eventually yields good glossing performance with consistent and consistently high gloss on a resulting image.

Figure 12:
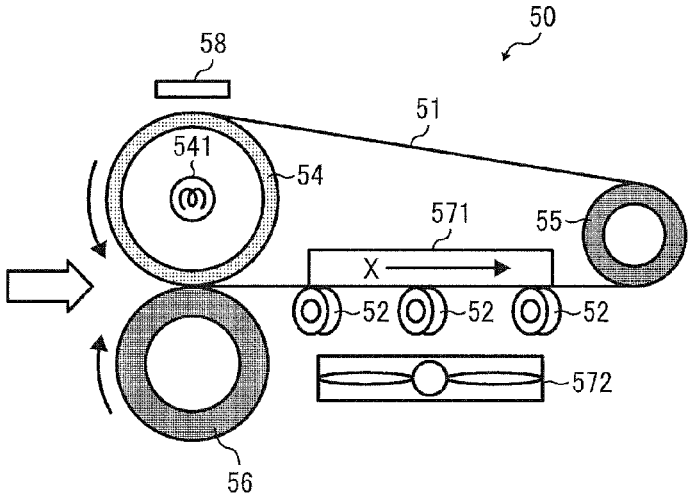
FIG. 12 is an end-on, axial view of the fixing device according to a fourth embodiment of this patent specification.
Figure 13:
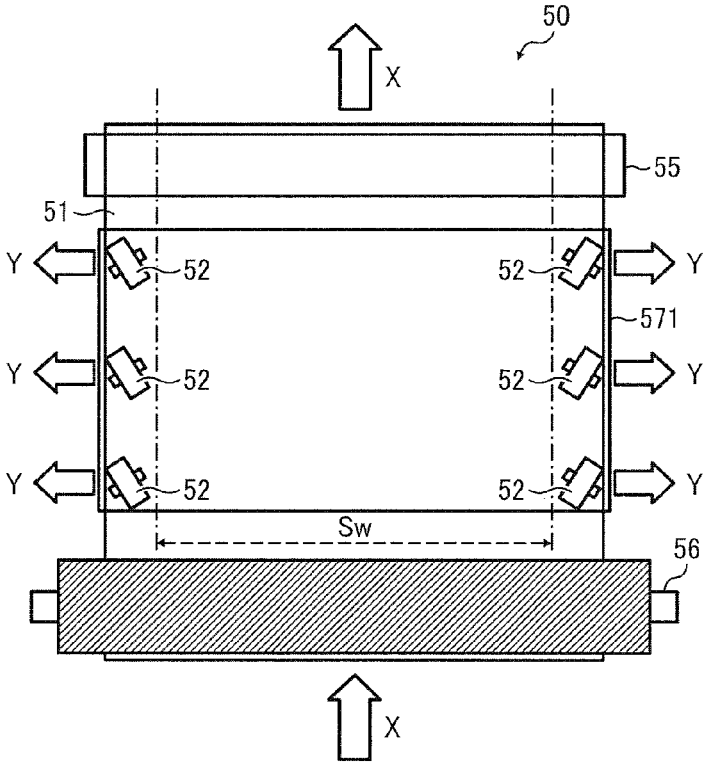
FIG. 13 is a bottom plan view of an endless belt provided with a belt tensioner included in the fixing device of FIG. 12.

FIG. 12 is an end-on, axial view of the fixing device 100 according to a fourth embodiment of this patent specification, and FIG. 13 is a bottom plan view of the endless belt 51 provided with the belt tensioner 52 included in the fixing device 100 of FIG. 12.

As shown in FIGS. 12 and 13, the overall configuration of the fourth embodiment is similar to that depicted in FIG. 3.

Unlike the first embodiment, however, the belt tensioner 52 in the present embodiment comprises multiple pairs of rotary members or wheels arranged in the longitudinal direction X of the belt 51 between the first and second rollers 54 and 55, each pair being disposed at opposed edges of the belt 51 outboard a width Sw of the recording sheet S accommodated in the fixing device 100.

Such arrangement allows the belt tensioner 52 to more thoroughly force or press against the belt edges along the length of the belt 51 in the longitudinal direction X, resulting in more secure, effective protection against loosening of the belt 51 than is possible with only a single pair of rotary tensioner members. High protection against loosening enables the belt 51 to maintain more close contact or proximity with the cooler 571, thereby increasing efficiency in cooling the belt 151 with the belt cooler 571, leading to uniform heat distribution across the belt 51 which eventually yields good glossing performance with consistent and consistently high gloss on a resulting image.

Figure 14:
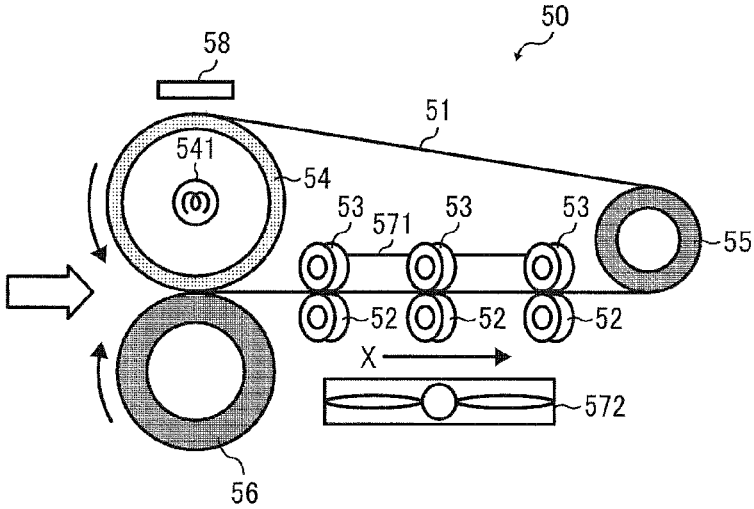
FIG. 14 is an end-on, axial view of the fixing device according to a fifth embodiment of this patent specification.
Figure 15:
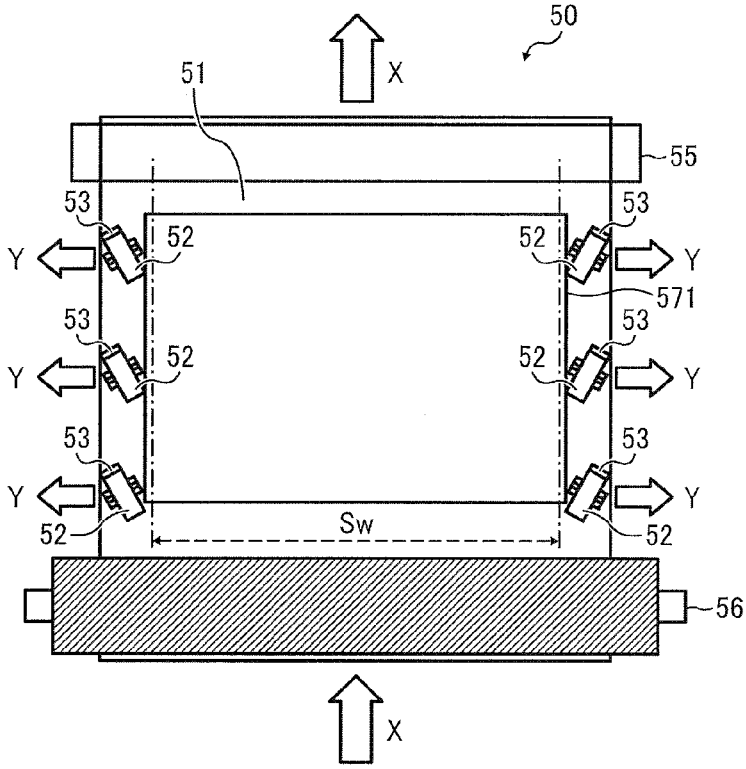
FIG. 15 is a bottom plan view of an endless belt provided with a belt tensioner included in the fixing device of FIG. 14.

FIG. 14 is an end-on, axial view of the fixing device 100 according to a fifth embodiment of this patent specification, and FIG. 15 is a bottom plan view of the endless belt 51 provided with the belt tensioner 52 included in the fixing device 100 of FIG. 14.

As shown in FIGS. 14 and 15, the overall configuration of the fifth embodiment is similar to that depicted in FIG. 3. Unlike the first embodiment, however, the belt tensioner 52 in the present embodiment comprises multiple pairs of rotary members or wheels arranged in the longitudinal direction X of the belt 51 between the first and second rollers 54 and 55, each of which pair is provided with a pair of backing members 53 inside the loop of the belt 51 between the first and second rollers 54 and 55, against which the rotary tensioner members 54 are pressed via the belt 51.

Each backing member 53 comprises a rotary member or wheel disposed opposite the tensioner wheel 52, so that the opposed rotary members 52 and 53 are pressed against each other via the belt 51. Although it is also possible to use a stationary backing member instead of a wheel to support pressure from the belt tensioner 52 via the belt 51, the rotary backing member 52 serves the intended purpose without causing excessive friction on the belt surface, which would otherwise result in accelerated wear and tear and/or unstable operation of the belt 51 conveying a recording sheet S.

Such arrangement allows the belt tensioner 52 to more thoroughly force or press against the belt edges along the length of the belt 51 in the longitudinal direction X, resulting in more secure, effective protection against loosening of the belt 51 than is possible with only a single pair of rotary tensioner members. High protection against loosening enables the belt 51 to maintain more close contact or proximity with the cooler 571, thereby increasing efficiency in cooling the belt 151 with the belt cooler 571, leading to uniform heat distribution across the belt 51 which eventually yields good glossing performance with consistent and consistently high gloss on a resulting image.

In particular, providing the backing member 53 to support pressure from the belt tensioner 52 enables the belt tensioner 52 to generate a sufficient, consistent tension in the belt 51, leading to more effective protection against loosening of the belt 51 with the belt tensioner 52.

Moreover, provision of the backing member 53 separate from the cooler 571 allows for use of a non-contact cooler, such as a fan, instead of a contact cooler, inside the loop of the belt 51 to cool the belt 51, leading to greater flexibility in the design of the fixing device 100. In such cases, pressing the belt 51 between the opposed wheels 52 and 53 allows for stretching the belt 51 independently in the transverse direction Y of the belt 51, which effectively prevents undesired creases in the belt 51, leading to good glossing performance of the fixing device 100.

In further embodiments, the belt tensioner 52, having multiple pairs of rotary tensioner members with multiple pairs of backing members, may be configured so that an interfacial plane between the belt tensioners 52 and the backing members 53 is offset toward the cooler 571 with respect to an interfacial plane between the cooler 571 and the belt 51. In such embodiment, the offset, or distance, between the interfacial planes may be dimensioned relative to a position of the belt tensioner 52 in the longitudinal direction X of the belt 51.

Although the fixing device 100 depicted in FIG. 3 has the glossing unit 50 positioned immediately downstream from the fixing unit 70 along the sheet conveyance path, the fixing device 100 according to this patent specification may be configured otherwise than specifically disclosed herein. For example, the glossing unit 50 may be provided at a separate position from the fixing unit 70, such as exterior to the image forming apparatus 1.

Moreover, the fixing device 100 may be configured without the fixing unit 70, that is, the glossing unit 50 may serve to fix a toner image by applying heat and pressure to a recording medium S, insofar as the glossing unit 50 functions in a manner substantially identical to that of the fixing unit 70. In such cases, the glossing unit 50 is according modified. For example, components of the glossing unit 50 may be dimensioned larger than those for a normal glossing application, so as to accommodate a relatively large amount of heat energy required for proper fixing of a toner image on a recording medium.

The image forming apparatus 1 incorporating the fixing device 100 according to one or more embodiments of this patent specification benefits from those and other effects of the fixing device 100.

Numerous additional modifications and variations are possible in light of the above teachings. It is therefore to be understood that, within the scope of the appended claims, the disclosure of this patent specification may be practiced otherwise than as specifically described herein.

What is claimed is:

1. A fixing device comprising:

a first roller;

a second roller parallel to the first roller;

an endless belt looped for rotation around the first and second rollers;

a third roller opposite the first roller via the belt;

a heater in at least one of the rollers to heat the roller to in turn heat the belt;

a cooler inside the loop of the belt between the first and second rollers to cool the belt, the first and third rollers pressing against each other to form a nip therebetween through which a recording medium is conveyed under heat and pressure as the belt moves from the first roller toward the second roller in a longitudinal direction of the belt, the recording medium remaining in contact with the belt cooled by the cooler during conveyance between the first roller and the second roller, and separating from the belt as the belt passes around the second roller; and a belt tensioner in contact with the belt configured to tension the belt in a transverse direction perpendicular to the longitudinal direction of the belt, wherein the belt tensioner comprises a pair of rotary members disposed at opposed edges of the belt outboard of a width of the recording medium accommodated in the fixing device, and each rotary tensioner member has a rotational axis thereof angled with respect to a surface of the belt between the first roller and the second roller.

2. The fixing device according to claim 1, wherein each rotary tensioner member is oriented outward with a rotational axis thereof angled with respect to the transverse direction of the belt between the first roller and the second roller.

3. The fixing device according to claim 2, wherein an angle between the rotational axis of the tensioner member and the transverse direction is in a range of from approximately 5 degrees to approximately 45 degrees.

4. The fixing device according to claim 2, wherein an angle between the rotational axis of the tensioner member and the transverse direction is in a range of from approximately 10 degrees to approximately 20 degrees.

5. The fixing device according to claim 1, further comprising a rotary driver connected to the rotary tensioner member to rotate the rotary member at a rotational speed higher than that of the belt.

6. The fixing device according to claim 1, wherein the rotary member comprises a wheel having a diameter of approximately 10 to approximately 40 millimeters, and formed of a material selected from the group consisting of aluminum, stainless steel, iron, and heat-resistant resin.

7. The fixing device according to claim 1, wherein the rotary member has an outer surface thereof coated with silicone or butyl rubber.

8. The fixing device according to claim 1, wherein the rotary tensioner member is pressed against the cooler via the belt.

9. The fixing device according to claim 1, further comprising a backing member inside the loop of the belt between the first and second rollers, wherein the rotary tensioner member is pressed against the backing member via the belt.

10. The fixing device according to claim 9, wherein an interfacial plane between the belt tensioner and the backing member is offset toward the cooler with respect to an interfacial plane between the cooler and the belt.

11. The fixing device according to claim 9, wherein the backing member comprises a rotary member disposed opposite the rotary tensioner member.

12. The fixing device according to claim 1, wherein the belt tensioner comprises multiple pairs of rotary members arranged in the longitudinal direction of the belt between the first and second rollers, each pair being disposed at opposed edges of the belt outboard a width of the recording medium accommodated in the fixing device.

13. The fixing device according to claim 1, wherein the belt tensioner is disposed facing an upstream end of the cooler in the longitudinal direction of the belt.

14. The fixing device according to claim 1, further comprising an auxiliary cooler outside the loop of the belt between the first and second rollers to assist in cooling the recording medium conveyed on the belt.

15. The fixing device according to claim 1, wherein the cooler comprises a cooling jacket.

16. The fixing device according to claim 1, wherein the cooler comprises a fan.

17. A fixing device comprising:

a fixing unit to fix a toner image on a recording medium conveyed in a conveyance direction; and a glossing unit disposed downstream from the fixing unit in the conveyance direction of the recording medium to impart gloss to the fixed toner image, the glossing unit comprising:

a first roller;

a second roller parallel to the first roller;

an endless belt looped for rotation around the first and second rollers;

a third roller opposite the first roller via the belt;

a heater in at least one of the rollers to heat the roller to in turn heat the belt;

a cooler inside the loop of the belt between the first and second rollers to cool the belt, the first and third rollers pressing against each other to form a nip therebetween through which a recording medium is conveyed under heat and pressure as the belt moves from the first roller toward the second roller in a longitudinal direction of the belt, the recording medium remaining in contact with the belt cooled by the cooler during conveyance between the first roller and the second roller, and separating from the belt as the belt passes around the second roller; and a belt tensioner configured to tension the belt in a transverse direction perpendicular to the longitudinal direction of the belt, wherein the belt tensioner comprises a pair of rotary members disposed at opposed edges of the belt outboard of a width of the recording medium accommodated in the fixing device, and each rotary tensioner member has a rotational axis thereof angled with respect to a surface of the belt between the first roller and the second roller.

18. An image forming apparatus comprising:

an imaging unit to form a toner image on a recording medium; and a fixing device to process the toner image with heat and pressure on the recording medium, the device comprising:

a first roller;

a second roller parallel to the first roller;

an endless belt looped for rotation around the first and second rollers;

a third roller opposite the first roller via the belt;

a heater in at least one of the rollers to heat the roller to in turn heat the belt;

a cooler inside the loop of the belt between the first and second rollers to cool the belt, the first and third rollers pressing against each other to form a nip therebetween through which a recording medium is conveyed under heat and pressure as the belt moves from the first roller toward the second roller in a longitudinal direction of the belt, the recording medium remaining in contact with the belt cooled by the cooler during conveyance between the first roller and the second roller, and separating from the belt as the belt passes around the second roller; and a belt tensioner in contact with the belt and configured to tension the belt in a transverse direction perpendicular to the longitudinal direction of the belt, wherein the belt tensioner comprises a pair of rotary members disposed at opposed edges of the belt outboard of a width of the recording medium accommodated in the fixing device, and each rotary tensioner member has a rotational axis thereof angled with respect to a surface of the belt between the first roller and the second roller.

* * * * *